US010281171B2

(12) United States Patent
Shaffer et al.

(10) Patent No.: US 10,281,171 B2
(45) Date of Patent: May 7, 2019

(54) WATER HEATER APPLIANCE

(71) Applicant: Haier US Appliance Solutions, Inc., Wilmington, DE (US)

(72) Inventors: Timothy Scott Shaffer, La Grange, KY (US); Jonathan Nelson, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 107 days.

(21) Appl. No.: 15/350,152

(22) Filed: Nov. 14, 2016

(65) Prior Publication Data

US 2018/0135885 A1 May 17, 2018

(51) Int. Cl.

| | |
|---|---|
| ***F24D 19/08*** | (2006.01) |
| ***F24H 4/04*** | (2006.01) |
| *F25D 21/14* | (2006.01) |
| *F24F 13/22* | (2006.01) |

(52) U.S. Cl.
CPC ..... *F24H 4/04* (2013.01); *F24D 19/088* (2013.01); *F24F 13/222* (2013.01); *F24F 2013/227* (2013.01); *F25D 21/14* (2013.01)

(58) Field of Classification Search
CPC ..... F24D 19/088; F24H 4/04; F24F 13/222; F24F 2013/227; F25D 21/14
USPC ..... 62/285–291
See application file for complete search history.

(56) References Cited

U.S. PATENT DOCUMENTS

| | | | | |
|---|---|---|---|---|
| 5,946,927 | A * | 9/1999 | Dieckmann | F24H 4/04 237/2 B |
| 6,084,520 | A | 7/2000 | Salvucci | |
| 6,442,955 | B1 * | 9/2002 | Oakner | F24F 13/222 62/150 |
| 6,992,259 | B1 * | 1/2006 | Cantolino | H01H 35/18 200/84 R |
| 7,191,649 | B1 * | 3/2007 | Coogle | G01F 23/74 73/313 |
| 8,169,314 | B2 * | 5/2012 | Cantolino | F24F 13/222 340/506 |
| 8,319,626 | B1 * | 11/2012 | Cantolino | G08B 21/20 122/13.01 |
| 8,422,870 | B2 | 4/2013 | Nelson et al. | |
| 2009/0064698 | A1 * | 3/2009 | Spanger | F24F 13/222 62/280 |
| 2011/0174714 | A1 * | 7/2011 | Hsiao | F24F 13/222 210/236 |

(Continued)

FOREIGN PATENT DOCUMENTS

| | | | |
|---|---|---|---|
| CN | 203928394 | U | 11/2014 |
| JP | 2006090605 | A | 4/2006 |
| WO | WO2009147803 | A1 | 12/2009 |

*Primary Examiner* — Filip Zec
(74) *Attorney, Agent, or Firm* — Dority & Manning, P.A.

(57) ABSTRACT

A drain pump assembly for discharging condensate from a water heater appliance is provided. The drain pump assembly includes a condensate collection tray positioned below an evaporator of the water heater appliance for collecting condensate. A condensate level sensor is configured for measuring a level of condensate within the condensate collection tray and is in operative communication with a drain pump. The drain pump is configured for discharging collected condensate from the condensate collection tray when the level of condensate exceeds a first threshold and turning off after the condensate level drops below a second threshold.

20 Claims, 9 Drawing Sheets

(56) References Cited

U.S. PATENT DOCUMENTS

| | | | | |
|---|---|---|---|---|
| 2012/0222439 | A1* | 9/2012 | Pena | F24F 11/30 62/150 |
| 2013/0174830 | A1 | 7/2013 | Neihouse et al. | |
| 2014/0216093 | A1* | 8/2014 | Kaiser | F24F 13/222 62/285 |
| 2016/0201929 | A1 | 7/2016 | Farris et al. | |

* cited by examiner

WATER HEATER APPLIANCE

FIELD OF THE INVENTION

The present subject matter relates generally to heat pump water heater appliances.

BACKGROUND OF THE INVENTION

Heat pump water heaters are gaining broader acceptance as a more economic and ecologically-friendly alternative to electric water heaters. These systems utilize a condenser configured in a heat exchange relationship with a water storage tank, for example wrapped around the tank in a series of coils. During operation of the vapor compression heat pump cycle, air flows across an evaporator and transfers energy to a refrigerant flowing through the evaporator. As such, the refrigerant exits the evaporator as a superheated vapor and/or high quality vapor mixture. Upon exiting the evaporator, the refrigerant enters a compressor where the pressure and temperature increase and the refrigerant becomes a superheated vapor. The superheated vapor from the compressor then enters the condenser, wherein the superheated vapor transfers energy to the water within a storage tank and returns to a saturated liquid and/or high quality liquid vapor mixture.

As heat is absorbed from the air flowing over evaporator, condensation forms which must be collected and discharged. Conventional heat pump water heaters rely on gravity to move collected condensate away from the heat pump water heater. However, this requires a user of such a water heater appliance to provide other means for disposing of the collected water, particularly when the water heater appliance is installed below ground level. For example, a user may need to install a pump and/or complicated drainage system to ensure that the collected water is discharged to a suitable drain.

Accordingly, a heat pump water heater appliance with features for disposing of collected condensate would be useful. More specifically, a heat pump water heater appliance having an integral means for discharging collected condensate with little user intervention would be particularly beneficial.

BRIEF DESCRIPTION OF THE INVENTION

The present disclosure provides a drain pump assembly for discharging condensate from a water heater appliance. The drain pump assembly includes a condensate collection tray positioned below an evaporator of the water heater appliance for collecting condensate. A condensate level sensor is configured for measuring a level of condensate within the condensate collection tray and is in operative communication with a drain pump. The drain pump is configured for discharging collected condensate from the condensate collection tray when the level of condensate exceeds a first threshold and turning off after the condensate level drops below a second threshold. Additional aspects and advantages of the invention will be set forth in part in the following description, or may be apparent from the description, or may be learned through practice of the invention.

In a first exemplary embodiment, a water heater appliance defining a vertical direction is provided. The water heater appliance includes a tank for holding water, a machinery compartment, and an evaporator disposed within the machinery compartment, the evaporator being configured to absorb heat and produce condensate. A condensate collection tray is disposed under the evaporator along the vertical direction and is configured for collecting the condensate from the evaporator. A drain pump including a pump inlet is in fluid communication with the condensate collection tray, the drain pump being configured for discharging the condensate from the condensate collection tray through a condensate discharge line.

In a second exemplary embodiment, a drain pump assembly for discharging condensate from a water heater appliance is provided. The drain pump assembly includes a condensate collection tray positioned below an evaporator of the water heater appliance. A drain pump including a pump inlet is in fluid communication with the condensate collection tray, the drain pump being configured for discharging condensate from the condensate collection tray through a condensate discharge line. A condensate level sensor is configured for measuring a level of condensate within the condensate collection tray, the drain pump being configured to turn on when the level of condensate reaches a first threshold and turn off when the level of condensate drops below a second threshold.

According to still another embodiment, a method for discharging condensate from a condensate collection tray of a water heater appliance is provided. The method includes positioning the condensate collection tray under an evaporator of the water heater appliance and collecting condensate in the condensate collection tray. The method further includes determining that a level of the condensate has reached a first threshold and activating a drain pump to discharge condensate from the condensate collection tray. The method then includes stopping the drain pump when a trigger event occurs.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
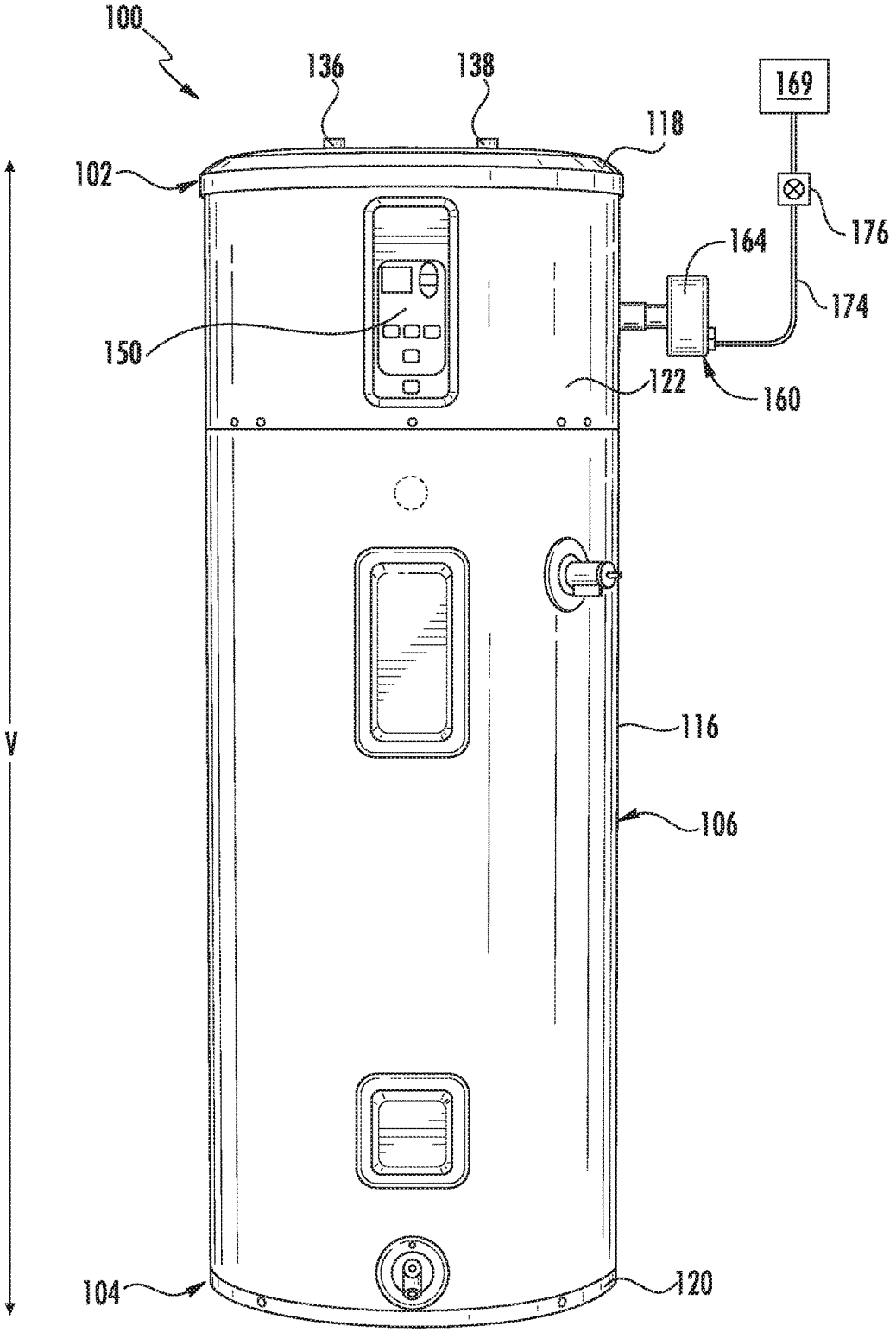
FIG. 1 provides a front elevation view of a water heater appliance according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a front elevation view of a water heater appliance 100 according to an exemplary embodiment of the present disclosure. The water heater appliance 100 defines a vertical direction V, and the water heater appliance 100 extends longitudinally between a top portion 102 and a bottom portion 104 along the vertical direction V. The water heater appliance 100 includes an outer shell or casing 106. The casing 106 generally surrounds a tank 108 (FIG. 2) such that the tank 108 is disposed within the casing 106. The tank 108 includes a top portion 110 and a bottom portion 112 spaced apart from one another along the vertical direction V. In addition, the tank defines an interior volume 114 extending between the top portion 110 and the bottom portion 112 along the vertical direction V.

The casing 106 may be formed from a variety of components. As illustrated, the casing 106 may include a wrapper 116, one or more covers, such as a top cover 118 and a bottom cover 120, and a shroud 122 as illustrated. The shroud 122 may be positioned at the top portion 110 of the tank 108 along the vertical direction V such that the shroud 122 defines a chamber 124 (FIG. 3) positioned over the tank 108 along the vertical direction V. According to the illustrated embodiment, chamber 124 serves as a machinery compartment for housing various operating components of water heater appliance 100. Additionally, the shroud 122 may define a one or more vents or apertures (not shown) that extend through the shroud 122 from or to the chamber 124 of the shroud 122.

Upper and lower heating elements 130, 132 (FIG. 2) and a sealed system 134 (FIG. 2) may also be positioned within the casing 106 for heating water within the tank 108. The upper and lower heating elements 130, 132 can be any suitable heating elements. For example, the upper heating element 130 and/or lower heating element 132 may be an electric resistance element, a microwave element, an induction element, or any other suitable heating element or combination thereof. The lower heating element 132 may also be a gas burner. As will be understood by those skilled in the art and as used herein, the term "water" includes purified water and solutions or mixtures containing water and, e.g., elements (such as calcium, chlorine, and fluorine), salts, bacteria, nitrates, organics, and other chemical compounds or substances.

The water heater appliance 100 also includes an inlet or cold water conduit 136 and an outlet or hot water conduit 138 that are both in fluid communication with a chamber or interior volume 114 (FIG. 2) defined by the tank 108. As an example, cold water from a water source, e.g., a municipal water supply or a well, can enter the water heater appliance 100 through the cold water conduit 136. From the cold water conduit 136, such cold water can enter the interior volume 114 of the tank 108 wherein the water is heated with heating elements 130, 132 and/or sealed system 134 to generate heated water. Such heated water can exit the water heater appliance 100 at the hot water conduit 138 and, e.g., may be supplied to a bath, shower, sink, or any other suitable feature.

As mentioned above, the water heater appliance 100 extends longitudinally between the top portion 102 and the bottom portion 104 along the vertical direction V. Thus, the water heater appliance 100 is generally vertically oriented. The water heater appliance 100 can be leveled, e.g., such that the casing 106 is plumb in the vertical direction V, in order to facilitate proper operation of the water heater appliance 100. It should be understood that the water heater appliance 100 is provided by way of example only and that the present subject matter may be used with any suitable water heater appliance, including for example any heat pump water heater appliance.

Figure 2:
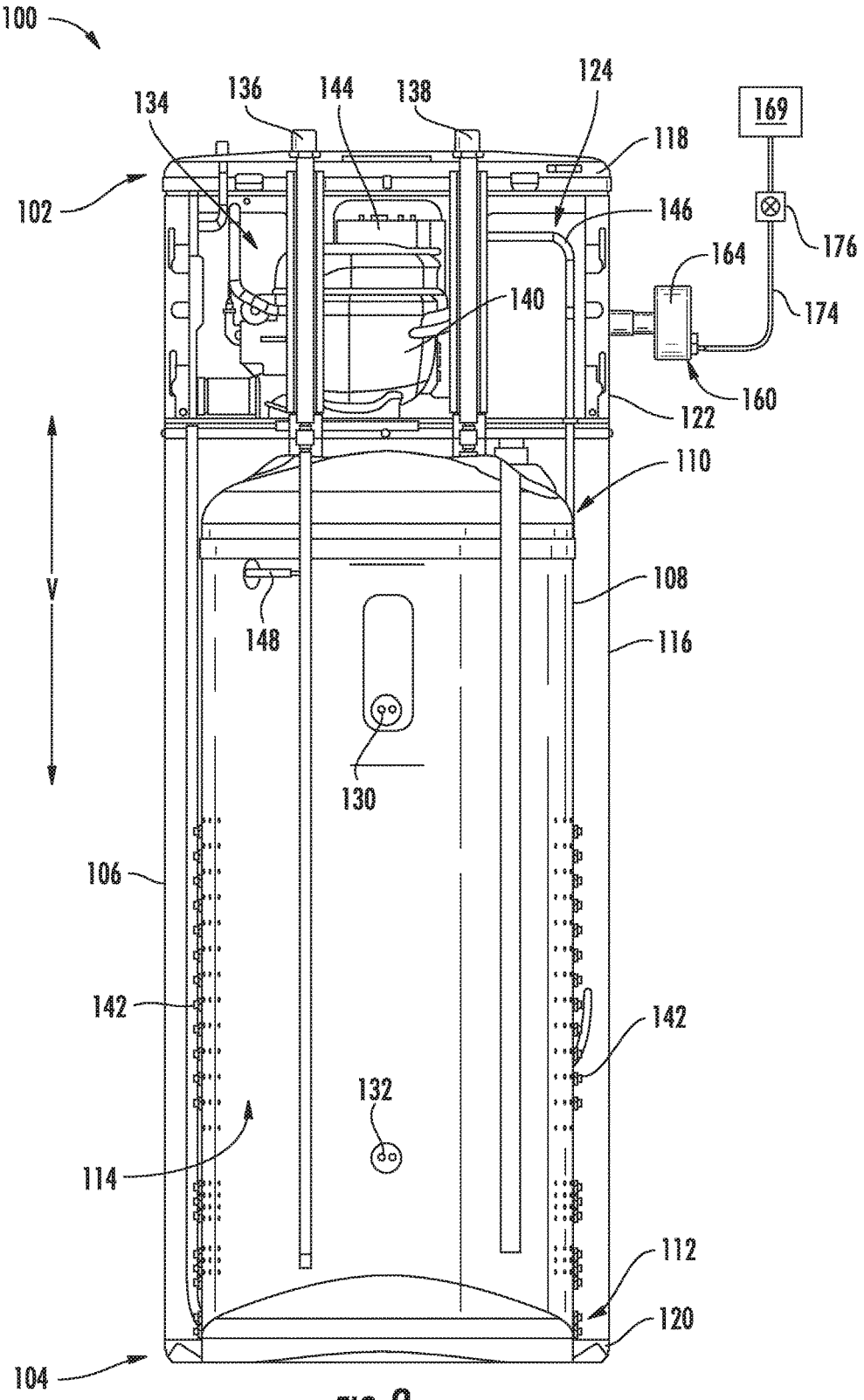
FIG. 2 provides a front section view of the exemplary water heater appliance of FIG. 1.

FIG. 2 provides a front section view of the water heater appliance 100. As may be seen in FIG. 2, the water heater appliance 100 includes the sealed system 134 for heating water within the interior volume 114 of the tank 108. The sealed system 134 generally operates in a heat pump cycle. Thus, the water heater appliance 100 is commonly referred to as a "heat pump water heater appliance." The water heater appliance 100 may additionally include one or more auxiliary heating elements, such as the upper heating element 130 and/or the lower heating element 132.

The sealed system 134 may include a compressor 140, a condenser 142 and an evaporator 144. The compressor 140 and/or evaporator 144 of the sealed system 134 may be disposed within the casing 106 at the top portion 102 of the water heater appliance 100, e.g., within the machinery compartment or shroud 122. As is generally understood, various conduits may be utilized to flow refrigerant between the various components of the sealed system 134. Thus, e.g., the evaporator 144 may be between and in fluid communication with the condenser 142 and the compressor 140. During operation of the sealed system 134, refrigerant may flow from the evaporator 144 through the compressor 140. For example, refrigerant may exit the evaporator 144 as a fluid in the form of a superheated vapor and/or high quality vapor mixture. Upon exiting the evaporator 144, the refrigerant may enter the compressor 140. The compressor 140 may be operable to compress the refrigerant. Accordingly, the pressure and temperature of the refrigerant may be increased in the compressor 140 such that the refrigerant becomes a superheated vapor.

The condenser 142 may be assembled in a heat exchange relationship with the tank 108 in order to heat water within the interior volume 114 of the tank 108 during operation of the sealed system 134. In particular, the condenser 142 may be positioned downstream of and in fluid communication with the compressor 140, and may be operable to heat the water within the interior volume 114 using energy from the refrigerant. For example, the superheated vapor from the compressor 140 may enter the condenser 142 wherein it transfers energy to the water within the tank 108 and condenses into a saturated liquid and/or liquid vapor mixture.

The sealed system 134 may also include a throttling device 146 between the condenser 142 and the evaporator 144. Refrigerant, which may be in the form of high quality/saturated liquid vapor mixture, may exit the condenser 142 and travel through the throttling device 146 before flowing through the evaporator 144. The throttling device 146 may generally expand the refrigerant, lowering the pressure and temperature thereof. The refrigerant may then be flowed through the evaporator 144.

The throttling device 146 may be any suitable components for generally expanding the refrigerant. For example, in some exemplary embodiments, the throttling device 146 may be a Joule-Thomson expansion valve, also known as a "J-T valve." In other exemplary embodiments, throttling device 146 may be an ejector. In still other exemplary embodiments, an electronic expansion valve, a capillary tube, a fixed orifice, or any other suitable apparatus may be utilized as throttling device 146.

The water heater appliance 100 may additionally include a temperature sensor 148. The temperature sensor 148 may be configured for measuring a temperature of water within the interior volume 114 of the tank 108. The temperature sensor 148 can be positioned at any suitable location within the water heater appliance 100. For example, the temperature sensor 148 may be positioned within the interior volume 114 of the tank 108 or may be mounted to the tank 108 outside of the interior volume 114 of the tank 108. The temperature sensor 148 may further be positioned within an upper portion of the tank 108. Alternatively, the temperature sensor 148 may be positioned within a lower portion of the tank 108. When mounted to the tank 108 outside of the interior volume 114 of the tank 108, the temperature sensor 148 can be configured for indirectly measuring the temperature of water within the interior volume 114 of the tank 108. For example, the temperature sensor 148 can measure the temperature of the tank 108 and correlate the temperature of the tank 108 to the temperature of water within the interior volume 114 of the tank 108. The temperature sensor 148 may be any suitable temperature sensor. For example, the temperature sensor 148 may be a thermocouple or a thermistor.

The water heater appliance 100 may further include a controller 150 that regulates operation of the water heater appliance 100. The controller 150 may be, for example, in operative communication with the sealed system 134 (such as compressor 140, and/or other components thereof), auxiliary heating elements, and/or temperature sensor 148. Thus, the controller 150 can selectively activate the sealed system 134 and/or auxiliary heating elements in order to heat water within interior volume 114 of tank 108.

The controller 150 includes memory and one or more processing devices such as microprocessors, CPUs or the like, such as general or special purpose microprocessors operable to execute programming instructions or micro-control code associated with operation of water heater appliance 100. The memory can represent random access memory such as DRAM, or read only memory such as ROM or FLASH. The processor executes programming instructions stored in the memory. The memory can be a separate component from the processor or can be included onboard within the processor. Alternatively, the controller 150 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

During operation of water heater appliance, evaporator 144 is generally configured to absorb heat, e.g., to increase the temperature of the refrigerant. As a result, condensation forms on the evaporator 144. For example, condensation may form as a result of latent heat released by the water vapor in the ambient air that is passed through evaporator 144. The apparatus and methods discussed herein provide an improved means for discharging collected condensate.

Figure 3:
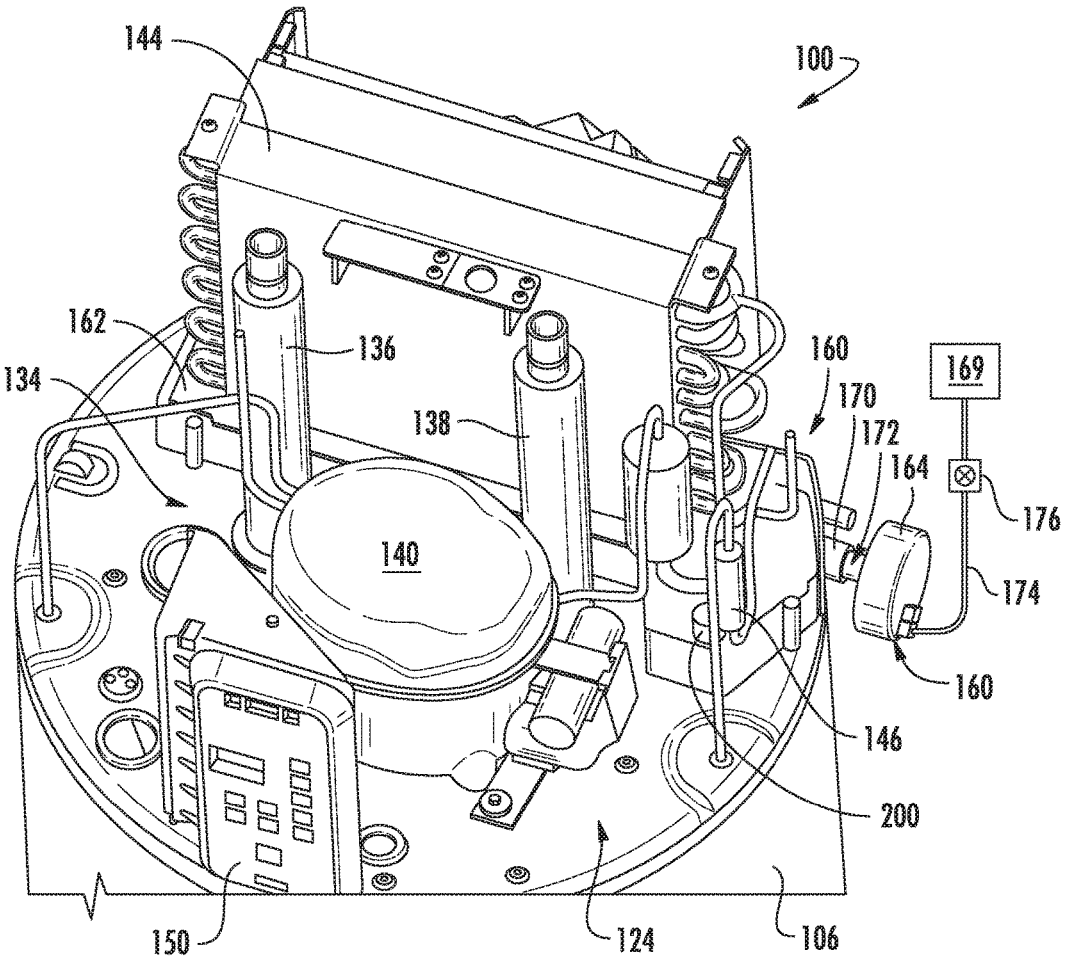
FIG. 3 provides a perspective view of a machinery compartment of the exemplary water heater appliance of FIG. 1, with a protective shroud and other components removed for clarity.
Figure 4:
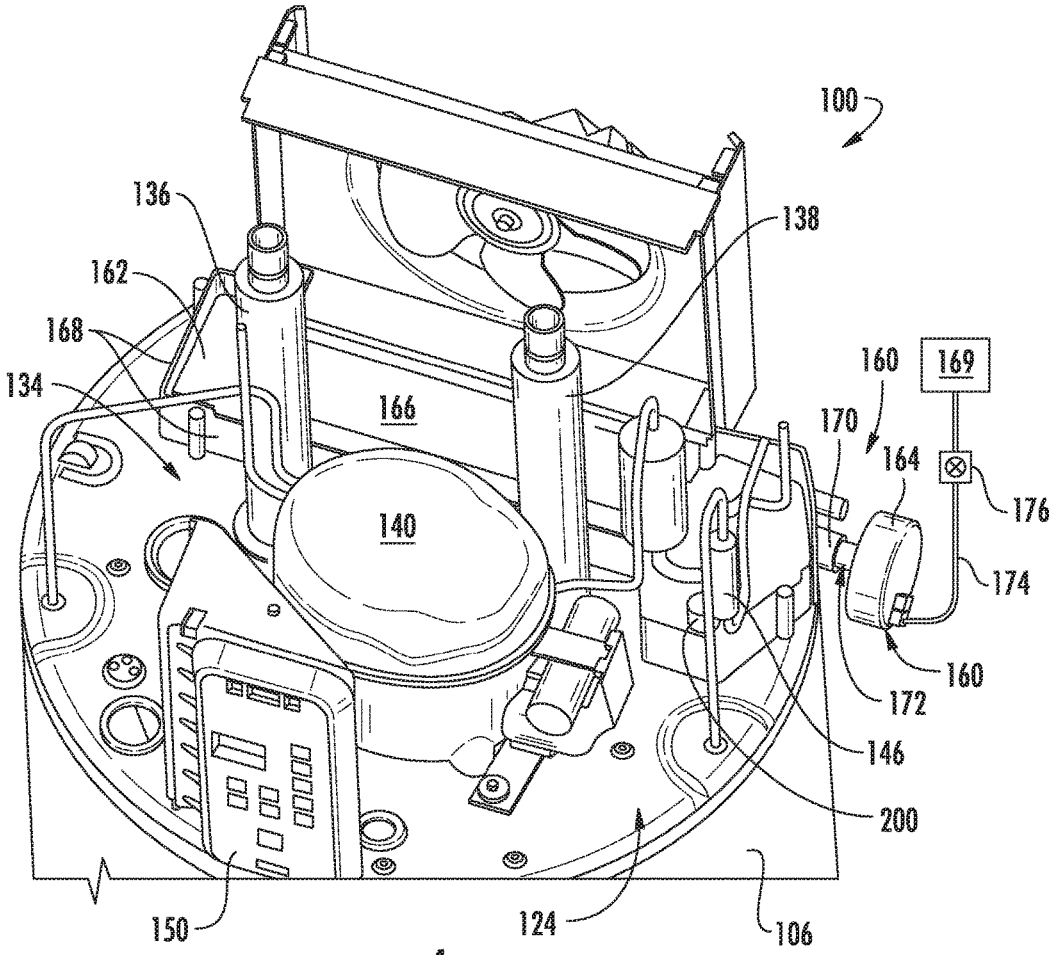
FIG. 4 provides a perspective view of some components of the exemplary machinery compartment of the exemplary water heater appliance of FIG. 1.

Referring now to FIGS. 3 and 4, a drain pump assembly 160 that may be used for collecting and discharging condensate from a water heater appliance will be described. More specifically, FIGS. 3 and 4 provide close-up, perspective views of a machinery compartment of chamber 124 of water heater appliance 100 with and without evaporator 144, respectively. Although drain pump assembly 160 is described herein as being configured for use in water heater appliance 100, it should be appreciated that drain pump assembly 160 may be used in any other suitable water heating appliance.

Drain pump assembly 160 generally includes a condensate collection tray 162 and a drain pump 164, each of which will be described below according to an exemplary embodiment of the present subject matter. As explained below, drain pump assembly 160 may be configured to discharge collected condensate without requiring expensive sensors, a larger footprint, or complex control algorithms.

According to the illustrated embodiment, condensate collection tray 162 is positioned below evaporator 144 of water heater appliance 100 along the vertical direction V. As illustrated, condensate collection tray 162 is a container having a bottom surface 166, four sides 168 extending from bottom surface 166 substantially along the vertical direction V, and an open top. As condensate forms on evaporator 144, it falls into condensate collection tray 162 where it is collected and prevented from falling into chamber 124 or over casing 106. By collecting the condensate, it may be discharged to a suitable drain, such as external drain 169.

Although condensate collection tray 162 is illustrated as having a larger footprint than evaporator 144, it should be appreciated that condensate collection tray 162 may be smaller than evaporator 144 according to some exemplary embodiments. In such a configuration, a condensate guide or path may be defined below evaporator 144 for directing condensate toward condensate collection tray 162 for collection.

According to an exemplary embodiment, condensate collection tray 162 may define a discharge port 170 through which condensate may pass to external drain 169. Although discharge port 170 is illustrated as being defined in one side 168 of condensate collection tray 162, it should be appreciated that discharge port 170 could alternatively be defined in bottom 166 of condensate collection tray 162. Moreover, condensate collection tray 162 may not include a discharge port 170 at all, but may instead rely on an overflow weir or on a discharge pipe positioned within the condensate collection tray 162 for evacuating collected condensate.

Referring still to FIGS. 3 and 4, drain pump 164 is positioned outside condensate collection tray 162 and includes a pump inlet 172 in fluid communication with condensate collection tray 162. More specifically, pump inlet 172 of drain pump 164 is fluidly coupled to discharge port 170 for drawing out and discharging condensate from condensate collection tray 162 through a condensate discharge line 174.

Although drain pump 164 is illustrated as being positioned outside condensate collection tray 162 and outside of chamber 124 and shroud 122, according to alternative embodiments, drain pump 164 could be positioned in any other suitable location where it is in fluid communication with condensate collection tray 162. For example, drain pump 164 may be positioned within chamber 124 and may be seated in and/or on condensate collection tray 162. In such embodiments, pump inlet 172 may be positioned within condensate collection tray 162 such that drain pump 164 may draw condensate directly from condensate collection tray 162 and condensate discharge line 174 may be routed out of shroud 122 and away from water heater appliance 100 to a suitable drain, e.g., external drain 169. For example, condensate discharge line 174 may routed through discharge port 170, or discharge port 170 may be plugged or removed and condensate discharge line 174 may extend up out of condensate collection tray 162 and through shroud 122. Other configurations are possible and within the scope of the present subject matter.

In order to prevent backflow of condensate into the condensate collection tray 162, drain pump assembly 160 may further include a check valve 176 positioned on condensate discharge line 174. Any suitable type of check valve or one-way valve may be used to stop the backflow and check valve 176 may be placed at any suitable location downstream of pump inlet 172.

Figure 5:
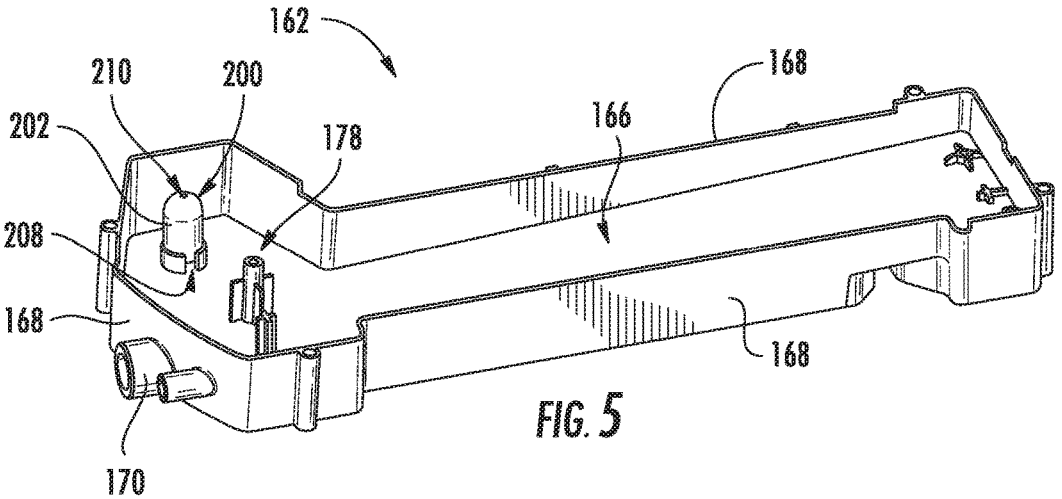
FIG. 5 provides a perspective view of a condensate collection tray of the exemplary water heater appliance of FIG. 1 according to an exemplary embodiment of the present subject matter.

Referring now also to FIG. 5, a perspective view of condensate collection tray 162 is provided. According to the illustrated embodiment, bottom 166 of condensate collection tray 162 is sloped along a plane perpendicular to the vertical direction such that condensate collection tray 162 defines a low region 178. In this manner, condensate has a tendency to flow toward and collect in low region 178 of condensate collection tray 162 under the force of gravity. By placing pump inlet 172 in low region 178 proximate bottom 166 of condensate collection tray 162, drain pump 164 can completely drain condensate from condensate collection tray 162 during a drain cycle.

Figure 6:
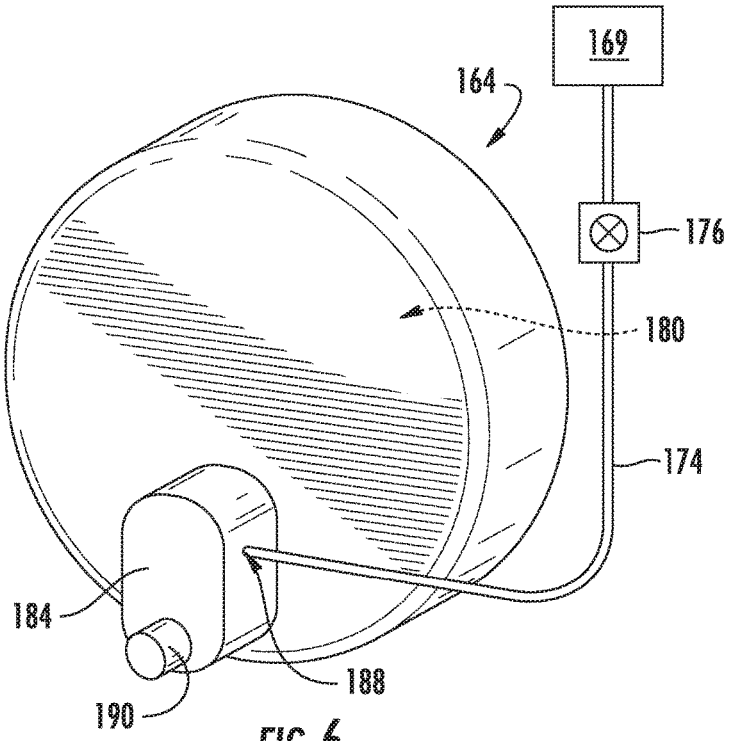
FIG. 6 provides a perspective view of a drain pump of the exemplary water heater appliance of FIG. 1 according to an exemplary embodiment of the present subj ect matter.
Figure 7:
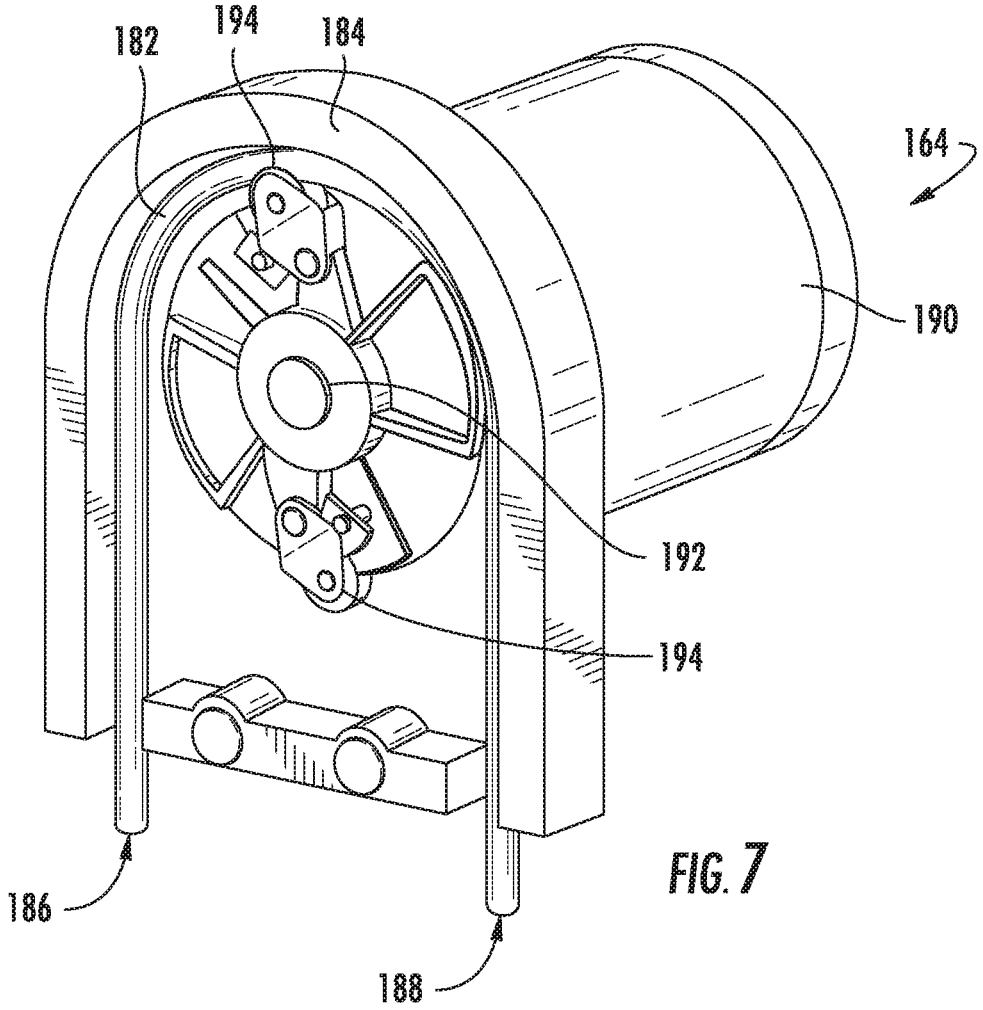
FIG. 7 provides a perspective view of the exemplary drain pump of FIG. 6, with the cover removed for clarity.

Referring now to FIGS. 6 and 7, drain pump 164 according to any exemplary embodiment of the present subject matter will be described. More specifically, FIG. 6 provides a perspective view of drain pump 164 and FIG. 7 provides a cross sectional view of drain pump 164. According to the illustrated exemplary embodiment, drain pump 164 is a peristaltic pump. As shown in FIG. 6, drain pump 164 includes a reservoir 180 for holding condensate liquid prior to pumping. In this regard, reservoir 180 may be a hollow cylindrical chamber that allows condensate liquid to collect in the bottom of reservoir 180 under the force of gravity.

As illustrated, drain pump 164 further includes a flexible tube 182 that is positioned within a circular housing 184. Flexible tube 182 may include, for example, an inlet 186 (FIG. 7) in fluid communication with pump inlet 172 and an outlet 188 in fluid communication with condensate discharge line 174. Although the illustrated embodiment contemplates inlet 186 being positioned within reservoir 180 and reservoir 180 being in fluid communication with condensate collection tray 162 via discharge port 170, it should be appreciated that according to alternative embodiments, inlet 186 may be placed directly within condensate collection tray 162, e.g., proximate low region 178, for drawing collected condensate out of condensate collection tray 162.

In general, peristaltic pumps are positive displacement pumps. In this regard, for example, a motor 190 is used to rotate a rotor assembly 192 including a plurality of rollers 194. During operation, rollers 194 press flexible tube 182 into an internal circumference of circular housing 184. As rollers 194 compress flexible tube 182 around circular housing 184, a flow of fluid, e.g., collected condensate, is drawn through inlet 186 and pumped through flexible tube 182 to outlet 188 and condensate discharge line 174. Although drain pump 164 is illustrated herein as a peristaltic pump, it should be appreciated that drain pump 164 may be any type of fluid pump having any size, configuration, or position suitable for drawing condensate from condensate collection tray 162 and discharging it through condensate discharge line 174.

Figure 8:
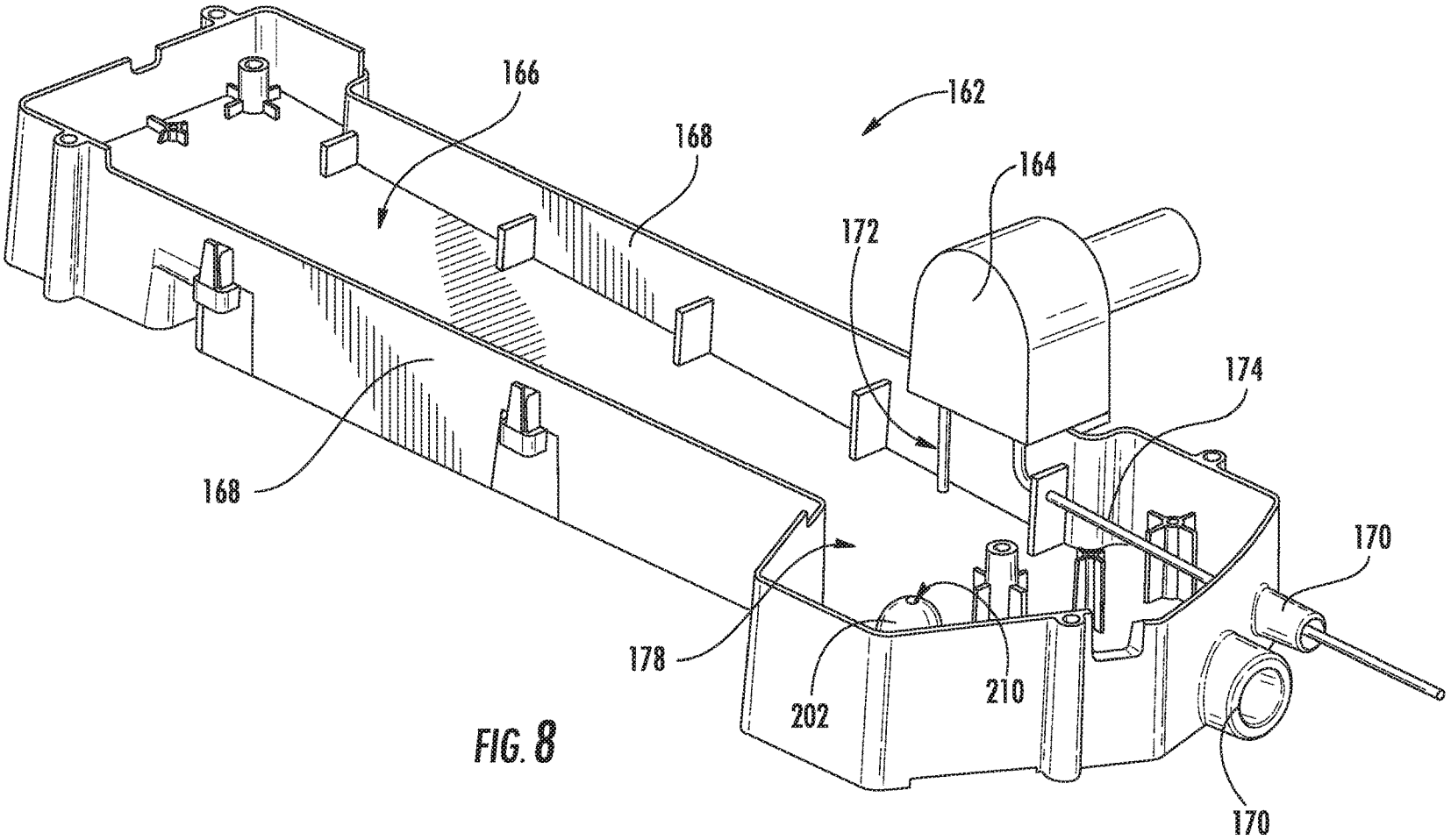
FIG. 8 provides a perspective view of a condensate collection tray of the exemplary water heater appliance of FIG. 1 according to another exemplary embodiment of the present subject matter.

Although drain pump 164 is illustrated in FIGS. 1 through 4 as being a peristaltic pump mounted to the outside of water heater 100 by discharge port 170, it should be appreciated that different types of pumps may be use while remaining within the scope of the present subject matter. In addition, drain pump 164 may be positioned at any other suitable location, either within water heater 100 or at any other location along the drain line. For example, FIG. 8 illustrates condensate collection tray 162 according to another exemplary embodiment. As illustrated, drain pump 164 is located within shroud 122 and is mounted directly to condensate collection tray 162. Thus, pump inlet 172 draws condensate directly from condensate collection tray 162 and discharges to external drain 169. According to the illustrated embodiment, condensate discharge line 174 passes through discharge port 170. However, according to alternative embodiments, discharge port 170 may be plugged, condensate discharge line 174 may pass directly through shroud 122, and other drain configurations may be used.

Figure 9:
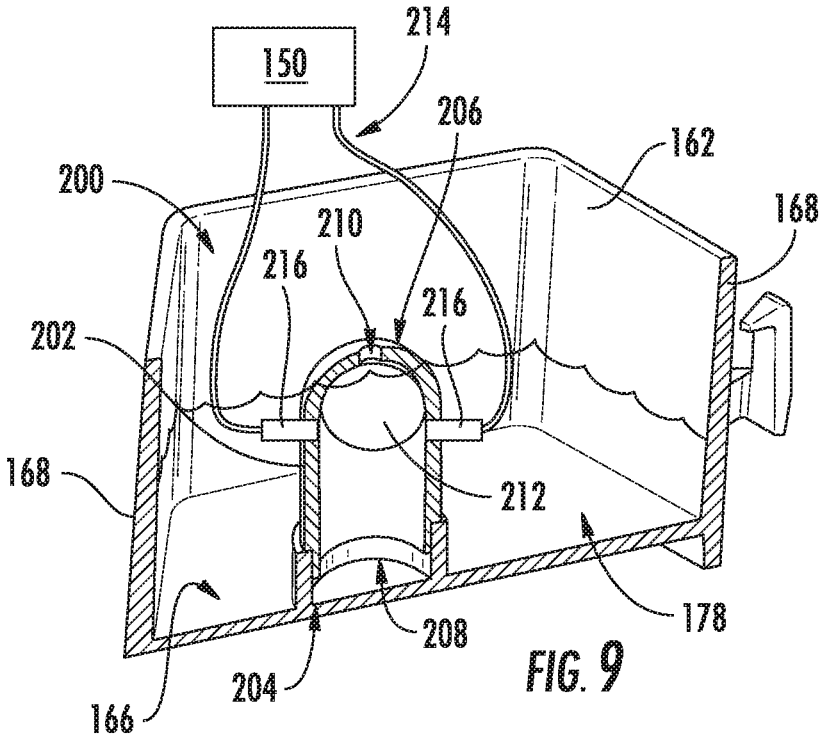
FIG. 9 provides a cross-sectional view of a condensate level sensor of the exemplary water heater appliance of FIG. 1 according to an exemplary embodiment of the present subject matter.

Referring now to FIGS. 5 and 9, a condensate level sensor 200 that may be used to improve the operation of drain pump 164 will be described according to an exemplary embodiment. More specifically, FIG. 5 illustrates the positioning of condensate level sensor 200 and FIG. 9 provides a cross sectional view of condensate level sensor 200 within condensate collection tray 162. Condensate level sensor 200 is generally configured for measuring a level of condensate within condensate collection tray 162. As shown in FIG. 5, condensate level sensor 200 is positioned in low region 178 of condensate collection tray 162 such that it may be used to accurately measure the level of condensate in the deepest portion of condensate collection tray 162.

According to some exemplary embodiments of the present subject matter, condensate level sensor 200 may generally include a high level sensor and a low level sensor. In this regard, when the level of condensate within condensate collection tray 162 reaches the high level sensor (or some other predetermined first threshold), drain pump 164 may be configured to turn on and begin discharging collected condensate through condensate discharge line 174. In order to prevent open ended operation of drain pump 164, drain pump 164 may be further configured to turn off when the level of condensate drops below the low level sensor (or some other predetermined second threshold). In this manner, collected condensate may be discharged from condensate collection tray 162 without the wasted energy and increased noise associated with continuous or prolonged operation of drain pump 164.

Referring now to the illustrated embodiment of FIG. 9, condensate level sensor 200 includes a sensor column 202 that extends from a bottom 204 to a top 206 along the vertical direction V. A column inlet 208 is defined in sensor column 202 proximate bottom 204 of sensor column 202. Column inlet 208 may be one or more slots extending through sensor column 202 and extending along the vertical direction V for a height that may be selected such that it is associated with the low level threshold.

In addition, sensor column 202 further defines a venting aperture 210 proximate top 206 of sensor column 202. A float 212 is positioned within sensor column 202 and is configured to move along the vertical direction V with the level of the condensate in sensor column 202. According to the illustrated embodiment, for example, float 212 is a resilient, circular, and buoyant ball and sensor column 202 is a cylindrical column configured to receive the buoyant ball. However, float 212 may be any suitable buoyant object that may be used to rise with the level of condensate and provide an indication of the condensate level. In addition, sensor column 202, column inlet 208, and venting aperture 210 may be any suitable size and shape, and may be placed in any suitable position and orientation.

During operation, as the level of condensate in condensate collection tray 162 rises, condensate enters column inlet 208, displaces air within sensor column 202 around float 212 and out venting aperture 210, and float 212 tracks the level of condensate. Notably, however, when float 212 reaches top 206 of sensor column 202, it is compressed into top 206 of sensor column 202 and seals off venting aperture 210. Thereafter, if the condensate level in condensate collection tray 162 drops, float 212 and condensate within sensor column 202 is trapped due to hydrostatic tension. The condensate trapped within sensor column 202 does not drop until the level of condensate falls to column inlet 208, at which point the hydrostatic tension is broken, the condensate falls into condensate collection tray 162, and the float 212 falls to bottom 204 of sensor column 202.

As illustrated in FIG. 9, condensate level sensor 200 may further include a continuity sensor 214 configured along with sensor column 202 for improved control of drain pump 164 and controlled discharge of collected condensate. More specifically, continuity sensor 214 is configured to sense when the level of condensate within sensor column 202 is above a predetermined threshold, e.g., a threshold where it is desirable to activate drain pump 164 and discharge collected condensate.

According to the illustrated embodiment, continuity sensor 214 is an electrical continuity sensor having two contacts or electrical leads 216 that form a closed circuit when the condensate in sensor column 202 exceeds the predetermined threshold. For example, electrical leads 216 may be positioned within sensor column 202 radially opposite from each other. Electrical leads 216 may be further connected to a controller, e.g., controller 150, such that a closed circuit is formed by condensate when it reaches the height of electrical leads 216. Drain pump 164 may be configured to operate while the continuity sensor 214 forms the closed circuit. Therefore, given the action of the level of condensate within sensor column 202 as described above, drain pump 164 may be configured to start when the level of condensate within sensor column 202 reaches a first (high) threshold and stop when the level of condensate within sensor column 202 reaches a second (low) threshold. Notably, the size and position of column inlet 208 and the position of electrical leads 216 along sensor column 202 may be adjusted as needed to control these threshold levels for a given application.

Now that the construction and configuration of water heater appliance 100 according to an exemplary embodiment of the present subject matter has been presented, an exemplary method 300 for operating a water heater appliance according to an exemplary embodiment of the present subject matter is provided. Method 300 can be used to operate any suitable water heater system or water consuming appliance. For example, method 300 may be utilized to operate water heater appliance 100 (FIGS. 1 and 2). In this regard, for example, controller 150 may be programmed to implement method 300. However, it should be appreciate that aspects of method 300 may be used to operate any suitable water heating appliance and to collect the condensate produced during its operation.

Figure 10:
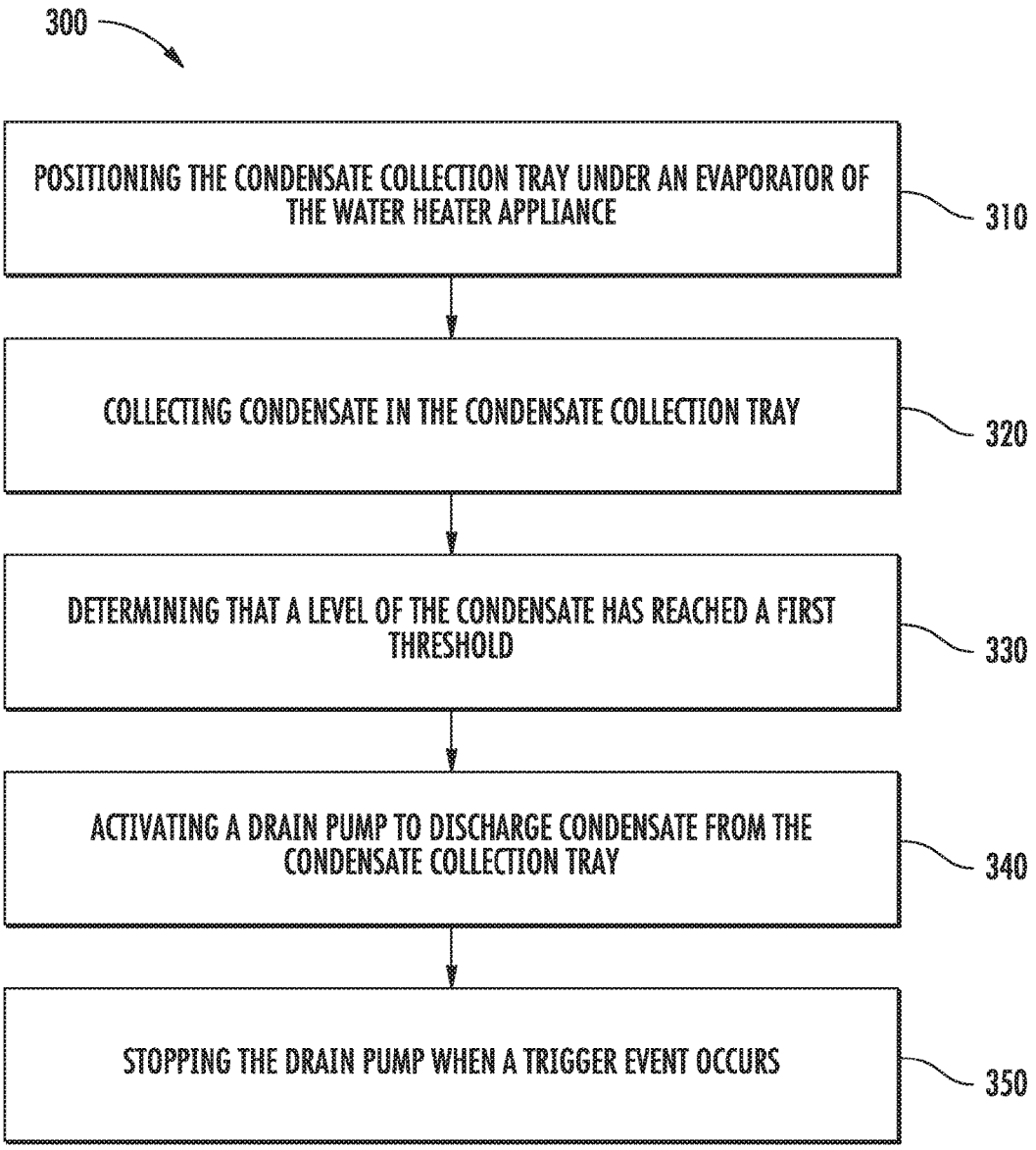
FIG. 10 illustrates a method for discharging condensate from a water heater appliance according to an exemplary embodiment of the present subject matter.

Referring now specifically to FIG. 10, method 300 may be used for discharging condensate from a condensate collection tray of a water heater appliance. Method 300 includes, at step 310, positioning the condensate collection tray under an evaporator of the water heater appliance. In this manner, condensate that collects on the evaporator may drop into the condensate collection tray at step 320. Method further includes, at step 330, determining that a level of the condensate has reached a first threshold. Step 340 includes activating a drain pump to discharge condensate from the condensate collection tray and step 360 includes stopping the drain pump when a trigger event occurs.

The trigger event may any suitable event, indication, or condition within the water heater appliance. The trigger event may be detected by a controller of the water heater appliance or may be the detected in any other manner in response to any particular event. For example, the trigger event may arise when the level of the condensate has reached the second threshold, for example, when the condensate level drops below a lower threshold. The lower threshold may be set, for example, by adjusting the height of the column inlet. According to another exemplary embodiment, the trigger event may be the lapse of a predetermined amount of time. For example, the drain pump may be configured to operate to discharge condensate for an amount of time necessary to discharge the entire condensate collection tray.

The water heater appliance and method of operation described above provide an integrated and effective means for discharging condensate that is collected from the evaporator coils. The condensate collection tray, the drain pump, and the liquid level sensor may integrated into the water heater appliance to simplify installation and reduce appliance footprint. The liquid level sensor may be configured in any suitable manner to start the pump and a stop the pump at the desired levels of the collected condensate without requiring the addition of complex and expensive water level sensors. It should be appreciated that aspects of drain pump assembly 160 and condensate level sensor 200 described herein are used only for the purpose of explaining aspects of the present subject matter. Other configurations are possible and within the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A water heater appliance defining a vertical direction, the water heater appliance comprising:

a tank for holding water;

a machinery compartment;

an evaporator disposed within the machinery compartment, the evaporator being configured to absorb heat and produce condensate;

a condensate collection tray disposed under the evaporator along the vertical direction and being configured for collecting the condensate from the evaporator;

a drain pump comprising a pump inlet in fluid communication with the condensate collection tray, the drain pump being configured for discharging the condensate from the condensate collection tray through a condensate discharge line; and a condensate level sensor configured for measuring a level of condensate within the condensate collection tray, the condensate level sensor comprising:

a sensor column extending from a bottom to a top along the vertical direction, wherein a column inlet is positioned proximate the bottom of the sensor column and a venting aperture is positioned proximate the top of the sensor column;

a continuity sensor configured to determine when the level of condensate is above a predetermined threshold; and a float positioned within the sensor column and configured to move along the vertical direction with the level of the condensate in the sensor column, wherein the float seals off the venting aperture when the float reaches the top of the sensor column such that condensate remains within the sensor column until the seal is broken when the condensate drops below the column inlet.

2. The water heater appliance of claim 1, wherein the drain pump is positioned within the machinery compartment of the water heater appliance.

3. The water heater appliance of claim 2, wherein the drain pump is positioned within the condensate collection tray.

4. The water heater appliance of claim 1, wherein the condensate collection tray has a sloped bottom that defines a low region where the condensate collects.

5. The water heater appliance of claim 4, wherein the pump inlet is positioned proximate the low region of the condensate collection tray.

6. The water heater appliance of claim 1, wherein the condensate collection tray defines a condensate discharge port, and wherein the drain pump is in fluid communication with the condensate discharge port.

7. The water heater appliance of claim 1, wherein the drain pump is a peristaltic pump.

8. The water heater appliance of claim 1, wherein a check valve is positioned on the condensate discharge line to prevent backflow of the condensate into the condensate collection tray.

9. The water heater appliance of claim 1, wherein the condensate level sensor includes a high level sensor and a low level sensor, and wherein the drain pump is configured to turn on when the float contacts electrical leads of a continuity sensor and turn off when the float breaks contact with the electrical leads.

10. The water heater appliance of claim 9, wherein the continuity sensor is an electrical continuity sensor having two contacts that form a closed circuit when the condensate in the sensor column exceeds the predetermined threshold, and wherein the drain pump is configured to operate while the electrical continuity sensor forms the closed circuit.

11. The water heater appliance of claim 1, wherein the float is a resilient, buoyant ball that is compressed into the top of the sensor column and held in place by hydrostatic tension until the level of condensate drops to the column inlet at the bottom of the sensor column.

12. A drain pump assembly for discharging condensate from a water heater appliance, the drain pump assembly comprising:

a condensate collection tray positioned below an evaporator of the water heater appliance;

a drain pump comprising a pump inlet in fluid communication with the condensate collection tray, the drain pump being configured for discharging condensate from the condensate collection tray through a condensate discharge line; and a condensate level sensor configured for measuring a level of condensate within the condensate collection tray, the drain pump being configured to turn on when the level of condensate reaches a first threshold and turn off when the level of condensate drops below a second threshold, wherein the condensate level sensor comprises:

a sensor column extending from a bottom to a top along the vertical direction, wherein a column inlet is positioned proximate the bottom of the sensor column and a venting aperture is positioned proximate the top of the sensor column; and a float positioned within the sensor column and configured to move along the vertical direction with the level of the condensate in the sensor column, wherein the float seals off the venting aperture when the float reaches the top of the sensor column such that condensate remains within the sensor column until the seal is broken when the condensate drops below the column inlet.

13. The drain pump assembly of claim 12, wherein the drain pump is positioned within the condensate collection tray in a machinery compartment of the water heater appliance.

14. The drain pump assembly of claim 12, wherein the condensate level sensor comprises a continuity sensor configured to determine when the level of condensate is above the first threshold.

15. The drain pump assembly of claim 14, wherein the continuity sensor is an electrical continuity sensor having two contacts that form a closed circuit when the float contacts the two contacts, and wherein the drain pump is configured to operate while the electrical continuity sensor forms the closed circuit.

16. The drain pump assembly of claim 12, wherein the float is a resilient, buoyant ball that is compressed into the top of the sensor column and held in place by hydrostatic tension until the level of condensate drops to the column inlet at the bottom of the sensor column.

17. A method for discharging condensate from a condensate collection tray of a water heater appliance, the method comprising:

positioning the condensate collection tray under an evaporator of the water heater appliance;

collecting condensate in the condensate collection tray;

determining that a level of the condensate has reached a first threshold using a sensor column having a float positioned therein and configured for closing an electrical continuity sensor when the float reaches a top of the column;

activating a drain pump to discharge condensate from the condensate collection tray; and stopping the drain pump when a trigger event occurs.

18. The method of claim 17, further comprising:

determining that a level of the condensate has reached a second threshold, wherein the trigger event occurs in response to determining that a level of the condensate has reached the second threshold.

19. The method of claim 17, further comprising:

determining that the drain pump has been activated for a predetermined amount of time, wherein the trigger event occurs in response to determining that the drain pump has been activated for the predetermined amount of time.

20. The method of claim 17, wherein the float is a resilient, buoyant ball that is compressed into the top of the sensor column and held in place by hydrostatic tension until the level of condensate drops to the column inlet at the bottom of the sensor column.

* * * * *